United States Patent [19]

Thoren

[11] 4,181,335

[45] Jan. 1, 1980

[54] PUSH RELEASE DOOR OPENER

[76] Inventor: Laurence R. Thoren, R.D. #1, Canton, Pa. 17724

[21] Appl. No.: 753,141

[22] Filed: Dec. 22, 1976

[51] Int. Cl.[2] ..... E05C 15/02; E05B 3/00

[52] U.S. Cl. ..... 292/92; 292/166; 292/336.3; 292/DIG. 65

[58] Field of Search ..... 292/336.3, 92, 93, 21, 292/DIG. 65, 139, 166, 167, 123, 127, 174, 276; 16/115, 114 R, 1; 49/55, 460

[56] References Cited

U.S. PATENT DOCUMENTS

| | | | |
|---|---|---|---|
| 943,973 | 12/1909 | Hope et al. | 292/92 |
| 1,353,523 | 9/1920 | Eustege | 292/275 |
| 1,860,780 | 5/1932 | Kees | 16/1 |
| 2,180,670 | 11/1939 | Erickson | 16/115 X |
| 2,871,050 | 1/1959 | Dickinson | 292/336.3 |
| 2,980,459 | 4/1961 | Schwanz et al. | 292/92 X |
| 3,025,095 | 3/1962 | Christensen | 292/336.3 |
| 3,144,268 | 8/1964 | Rowe | 292/336.3 |

*Primary Examiner*—Roy D. Frazier
*Assistant Examiner*—William E. Lyddane
*Attorney, Agent, or Firm*—Harding, Earley & Follmer

[57] ABSTRACT

A push release door opener for aluminum storm and screen doors having a push handle comprising a lightweight, inexpensive aluminum push rail with a C-shaped cross-section with top and bottom grooves forming a track and having a first and second end, an adjusting bar slidably attached through the first push rail end to the push rail and slidable in the track formed by the top and bottom grooves, the adjusting bar having a first end which is slidable in the track and a door-attaching end which extends away from the end of the push rail, the adjusting bar further having a Z-shaped bend formed in the door-attaching end for providing a desirable offset of the push rail from the door and for enhancing the inherent resilience of the adjusting bar, the door-attaching end of the adjusting bar being attached to a solid part of the door at the hinge side of the door opposite the handle and at substantially the same level as the handle, and a U-shaped hook slidable in the track of the push rail and operative to connect the second push rail end to the handle of the door whereby a gentle push against the push rail with any part of the body is effective to release the push handle latch to open the door, thereby freeing the hands for other purposes. The push release door opener is easily installed within minutes by one having little or no mechanical experience. There is no interference with the locking and latching mechanism on the door. The push release door opener is further characterized by its versatility, fitting most door widths, and by its ease of removal, if necessary, for changing the screens and storm windows.

1 Claim, 7 Drawing Figures

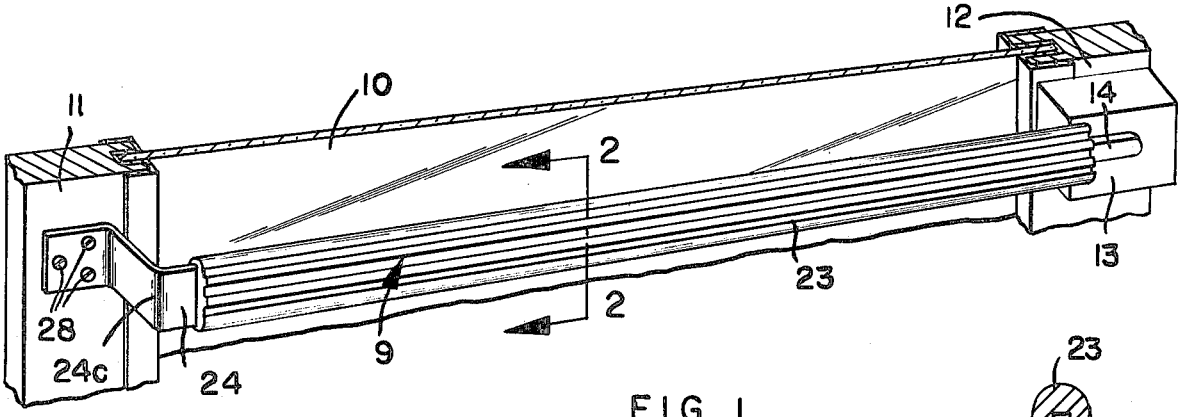
FIG. 1.
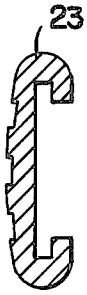
FIG. 2.
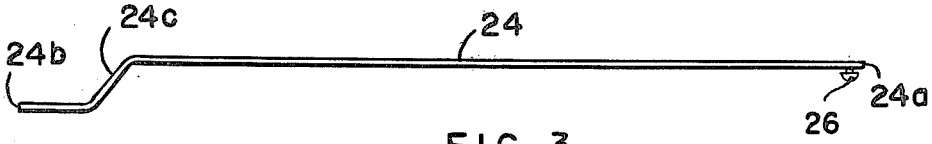
FIG. 3.
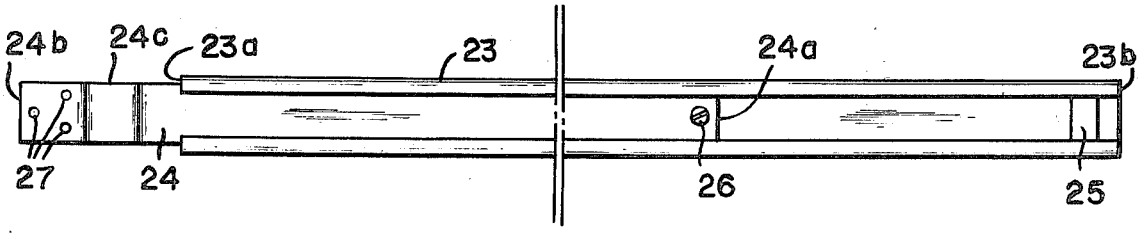
FIG. 5.
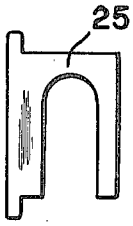
FIG. 4.
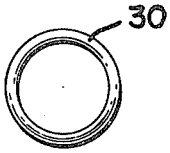
FIG. 6.
FIG. 7.
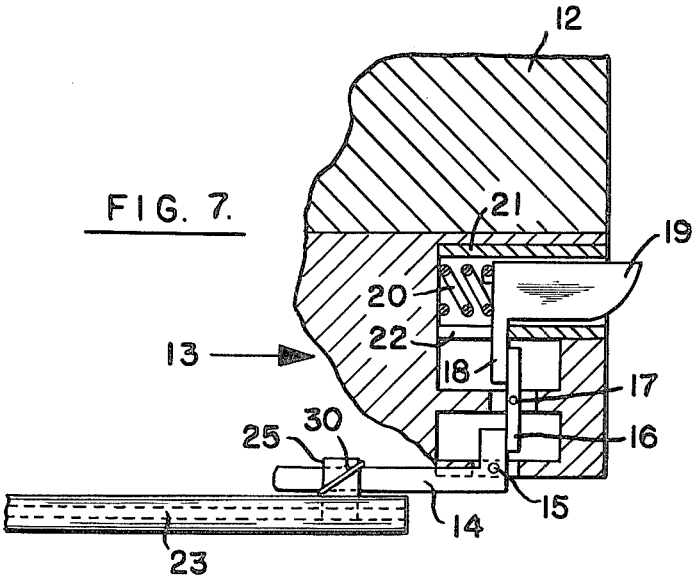

PUSH RELEASE DOOR OPENER

BACKGROUND OF THE INVENTION

1. Field of the Invention

This invention relates to improvements in push release structures for opening, by body thrust, vertically hinged storm and screen doors and the like having push-latch handles.

2. Description of the Prior Art

Push bar mechanisms providing body thrust release means for opening latched vertically hinged doors in emergency, panic and other situations are known in the prior art. Examples of such latch mechanisms are shown in U.S. Pat. Nos. 2,104,618 and 2,992,846. In U.S. Pat. No. 2,104,618 a riot lock mechanism is disclosed in which a bar, when pushed, is moved against the bias of a leaf spring to retract the bolt of a door lock. In one form the bar is connected to and draws on a chain movable over a roller to retract the bolt. In another form the bar is connected to and rocks a lever equipped with a roller to effect such bolt retraction. The bar is pivoted at one end to a fixed bracket provided on the side of the door opposite the latch. U.S. Pat. No. 2,992,846 also shows a door latch in which a resilient push bar is supported by a bracket on the side of the door opposite the latch. The push bar includes a straight portion which extends horizontally across the door and a curved portion which extends through an aperture or bore in the door adjacent the latch. A connection is provided between the curved portion of the push bar and the latch whereby the latch is released when the bar is pushed by the human body. When installing the push bar latch releasing mechanism, the aperture in the door must be especially formed, for example, by drilling a bore of cylindrical shape by a brace and bit. The latch is an integral part of the push bar mechanism and is insertable through and accommodated by the bore. The push bar mechanism is described as being readily adaptable for use on doors varying widely in width by cutting the bar to the proper length for the particular door upon which installation is to be made. It is apparent that these prior art body-thrust push-bar door opening mecanisms leave much to be desired from the standpoint of simplicity, ease of installation, and ease of removal.

SUMMARY OF THE INVENTION

An object of the present invention is to provide an improved and inexpensive push release door opener structure for aluminum storm and screen doors with push handle latches, a door opener that requires only a gentle nudge by the human body to open the door. A further object is to provide such a push release structure that fits easily on push handles already present on storm and screen doors, and is characterized by the ease and speed with which it may be installed on storm and screen doors of different widths, requiring no cutting of the push bar to a proper length, nor the drilling of a bore in the door to accommodate the latch and push bar, nor the use of special brackets.

In accomplishing these and other objects, the push release door opener of the present invention is made from a length of lightweight, inexpensive aluminum bar or rail, termed a "push rail" hereinafter, which is C-shaped in cross-section, a length of similar aluminum bar rectangular in cross-section, termed hereinafter an "adjusting bar", and an inverted U-shaped hook. The adjusting bar is slidable longitudinally in a track formed in the C-shaped length of the push rail for adapting the effective length of the assembled push rail and adjusting bar to the width of the door on which the push release door opener is installed. Several holes, for example, three, are provided in the door-attaching end of the adjusting bar, that is, the end of the bar remote from the push rail, for screw attachment of the adjusting bar to a solid part of the door. Such attachment is made at the hinge side of the door, desirably at substantially the same level as the latch although not necessarily so. A Z-shaped bend is formed near the door-attaching end of the adjusting bar for providing a desirable offset of the push rail from the door and for enhancing the inherent resilience of the adjusting bar. The U-shaped hook is slidable in the track of the push rail and is attached to the push handle of the aluminum storm or screen door on which the assembled push release door opener is installed.

With this structural arrangement a gentle push against the push rail with any part of the body is effective to release the push handle latch to open the door. When the pressure against the push rail is released, the inherent resilience of the adjusting bar restores the latch to its closed position. Accordingly, the installation of the push release door opener of the present invention on an aluminum storm and screen door having a push handle latch provides the latch with an easy open panic bar. By the simple removal of the screws attaching the adjusting bar to the door, the push release door opener may be removed, thereby facilitating the changing of screens and storm windows.

BRIEF DESCRIPTION OF THE DRAWINGS

A better understanding of the invention may be had from the following detailed description when read in connection with the accompanying drawings wherein:

FIG. 1 is a fragmentary sectional view taken through the medial portion of a vertically hinged storm or screen door on which the novel push release door opener according to the present invention has been installed;

FIG. 2 is a vertical cross-section of the C-shaped push rail of the door opener taken as indicated by the lines and arrows 2—2 in FIG. 1;

FIG. 3 is a bottom plan view of the adjusting bar of the door opener of FIG. 1 showing the Z-shaped bend formed at the door-attaching end of the adjusting bar;

FIG. 4 is an end view of the inverted U-shaped hook member looking from the right in FIG. 1;

FIG. 5 is a view in elevation, with a portion broken away, showing the assembly of the push rail, the adjusting bar, and the U-shaped hook as seen from the storm or screen door of FIG. 1;

FIG. 6 shows an O-ring of neoprene or rubber for the resilient attachment of the door release opener to the push handle of the door; and FIG. 7 is a schematic illustration of a type of push handle latch with which the push release door opener of the present invention may be utilized.

DESCRIPTION OF THE PREFERRED EMBODIMENT

Referring now to the drawings, the improved push release door opener 9 of the present invention is shown operatively mounted upon the inside of a conventional type of aluminum storm or screen door 10, hinged in the usual manner (not shown) from the left longitudinal edge or rail 11, as seen in FIG. 1. The free edge of the door at the right longitudinal edge or rail 12 is provided with a push handle latch 13 of known type which cooperates with the usual door jamb (not shown). As is customary, the door jamb is provided appropriately at its inwardly offset vertical portion with a strike plate for engaging and securing the latch bar of the latch 13. The latch 13 is provided with a push lever or handle 14 that when pushed toward the door releases or disengages the latch bar from the strike plate, releasing the door and allowing it to swing open. The latch 13 forms no part of the present invention and may be of any commercially available type having a push handle 14 or similar member which when pushed toward the door serves to release the latch thereby allowing the door to be swung open.

By way of illustration and not limitation, one form which such a door latch may take is illustrated in the schematic diagram of FIG. 7 wherein the push handle 14 is shown suitably pivoted at pin 15. When pushed toward the door 10, push handle 14 is angularly rotated about pivot pin 15 to rotate a pivoted bar 16 in a counterclockwise direction. Bar 16 is carried by a suitable pivot pin 17 and when rotated in a counterclockwise direction engages an extending member 18 of a latch bar or bolt 19, pushing the latter to the left against the force of a helical spring 20, thereby disengaging the latch bolt 19 from the strike bar (not shown) associated with the door jamb. When the pressure on handle 14 is released, the latch bolt 19 is returned to its closed position where it is effective to engage the strike bar for holding the door closed. The latch bolt 19 is supported for movement in a suitable member 21 which, for example, may comprise a cylinder 21 having a slot 22 therein for allowing transverse movement of the extending member 18. Suitable means, not shown, are provided for angularly deflecting the lever 16 to release the latch for opening the door from the outside of the door.

The push release door opener 9 according to the present invention is operative, when installed, to effect the pushing of the push handle 14 merely by the gentle nudging of a convenient push rail 23, without requiring the use of the hands to operate the handle 14 when opening the door 10. The hands accordingly are free to carry loads in the arms, for example, children, packages, groceries, garbage and trash, and make it unnecessary to stop and juggle such loads when trying to open the door. A gentle push with any part of the body against the push rail 23 is all that is required to open the door. The push rail 23, moreover, provides a protective barrier against glass and screen breakage, particularly by children whose hands no longer need fumble with the usual small latch handle. Additionally, the push rail 23 provides handrail support for adults as well as children, thereby preventing falls.

As seen in FIGS. 1 through 6, push release door opener 9 includes, in addition to the push rail 23, an adjusting bar 24 and an inverted U-shaped hook 25. The push rail 23 has a C-shaped cross-section with top and bottom grooves forming a track and having a first end **23*a* and a second end 23*b*. The adjusting bar 24 and hook 25 are slidable in the push rail 23. Specifically, the adjusting bar 24 is slidably attached to the push rail 23 through the first push rail end 23*a* in the track formed by the top and bottom grooves of the push rail 23. The adjusting bar 24 has a first end 24*a* which is slidable in said track of the push rail 23 and a door-attaching end 24*b* which extends away from the push rail 23. The adjusting bar 24, as shown in FIG. 3, is formed with a Z-shaped bend 24*c* at its door-attaching end 24*b* and is provided with a screw 26 adjacent the other end 24*a* for fixing the push rail 23 and adjusting bar 24 against relative longitudinal movement when their relative positions have been adjusted as required to fit the width of the door. The adjusting bar 24, as seen in FIG. 5, is provided adjacent its end 24*b* with three small holes 27 for attaching, by suitable screw means 28, the end 24*b* of adjusting bar 24 to the hinge rail 11 of door 10**.

In the installation of push bar door opener 9 to a storm or screen door 10, the push bar assemblage 9 as seen in FIG. 5, is placed adjacent the door 10 and the U-shaped hook 25 is hooked over push handle 14 of latch 13. With the adjusting bar 24 extended so that the holes 27 in its end **24*b* are positioned over the solid part of hinge rail 11, at a position level with the latch 13, the location of the three holes is marked on the rail 11. The assemblage 9 as seen in FIG. 5 is then removed from the door, and the three holes 27 are drilled through the first layer of aluminum of the rail 11 of the door 10, using, for example, a one-eighth inch bit to drill the holes. The holes 27 are drilled through the first layer only of the rail 11 since most aluminum doors have hollow centers and the holes 27 should not be drilled through the outside layer of the door. The push release assemblage 9 is then again brought adjacent to the door and the U-shaped hook 25 is again hooked over the push handle 14. Desirably, there should be some play and not a rigid tight fit in the connection of the hook 25 to the handle 14. The use of the resilient O-ring 30 shown in FIG. 6 facilitates such a connection and prevents the V-shaped hook 25 from sliding on push handle 14. If desired, the O-ring 30 may be looped over the handle 14, and over the U-shaped hook 25 inserted through the open loop of the O-ring. The U-shaped hook 25 is then placed over the handle 14 of the push latch 13. The size of the O-ring 30 may be selected as required, an O-ring 30** of about one-half inch in diameter being suitable for many installations.

At the hinge end of the assemblage 9, the adjusting bar 24 is attached to the rail 11 of the door 10 using the three screws 28, as seen in FIG. 1. Desirably, the angle of offset of the Z-shaped bend in the adjusting bar 24 is such as to slightly urge the push bar door opener assemblage 9 away from the door 10 thereby to hold the push handle 14 in the closed position of latch 13. The force with which the handle 14 is urged to this latch closing position may be adjusted by changing the angle of the Z-shaped bend in the adjusting bar 24 although it is noted that in most installations such adjustment is not necessary.

In operation, body-thrust such as a gentle nudge against the push rail 23 pushes the handle 14 toward the door 10, thereby releasing the latch 13 and allowing the door to swing open. No fixed, rotating pivot is a part of the structure of push release door opener 9, the resilience of the aluminum in the push rail 23 and adjusting bar 24, particularly at the Z-shaped end of the adjusting bar 24, providing the necessary resilience. Only slight pressure against the push rail 23 is required to release the latch 13. Thus one wishing to open the door but whose hands are otherwise occupied may apply body-thrust against the push rail 23 as, for example, hips or stomach, until the door is fully opened.

As will be evident, the push release door opener 9 according to the present invention is easily installed, even by a housewife, within minutes. There is no interference with the locking and latching mechanisms that already are provided on the door. The mechanism is easily adjustable and fits most commercially available door widths. Desirably, the push rail 23 and the adjusting bar 25 may be anodized to protect these members against weather conditions. Various motif designs or baked enamel finishes may also be provided particularly for the push rail 23 for styling the door opener 9 to match the aluminum storm or screen door 10 on which the door opener 9 is installed.

Thus there has been provided in accordance with the present invention a very simple but highly efficient and economical push release door opener 9 which requires only a gentle push with any part of the body to open the door 10, and which is quickly and easily mounted upon aluminum storm and screen doors, utilizing the push handle 14 already provided on the door, and requiring only simple attachment, and easy removal, of the door opener 9 to the door 10.

I claim:

1. An easily installable push release door opener for aluminum storm and screen doors and the like having push handle latches comprising, a push rail having a C-shaped cross-section with top and bottom grooves forming a track and having a first and second end, an adjusting bar slidably attached through said first push rail end to the push rail and slidable in said track formed by said top and bottom grooves, said adjusting bar having a first end which is slidable in said track and a door-attaching end which extends away from the said push rail, attaching means for mounting the door-attaching end of the adjusting bar onto the door, connecting means mounted on said second push rail end for operatively connecting said push rail to the push handle of the door whereby body thrust of a person against the said push rail is effective to release the door latch and to open the door thereby releasing the hands of the person for other purposes, wherein said adjusting bar is provided with a Z-shaped bend near its door-attaching end whereby the inherent resilience of said adjusting bar is enhanced and said push rail is offset from said door, said adjusting bar being slidable in said track of said push rail for adjusting said door opener to the width of the door, wherein means are provided for holding said push rail and adjusting bar in said adjusted position, wherein said connecting means for connecting said push rail to the push handle of the door comprises an inverted U-shaped hook mounted on the push rail and placeable over the handle of the door and a stretchable O-ring for resiliently holding said inverted U-shaped hook and the door handle together, wherein said adjusting bar has an inherent resilience and the mounting of the door-attaching end of said adjusting bar on the door is such as to utilize said inherent resilience normally to provide a biasing force on said push rail and the door push handle in a first direction such as to allow said handle to assume its door closing position, said inherent resilience also allowing sufficient deflecting movement of said push rail upon application thereto of body thrust to push the handle of the door in the opposite direction to its door latch releasing position, wherein said attaching means comprises screw means, wherein the door-attaching end of said attaching bar is attachable to the door at a position that is substantially at the same level as the push handle on the door, and said inverted U-shaped hook is in slidable attachment to said push rail.

* * * * *